United States Patent [19]

Storandt

[11] 4,236,727

[45] Dec. 2, 1980

[54] SAFETY TOE UNITS FOR SKI BINDINGS

[75] Inventor: Ralf Storandt, Leonberg, Fed. Rep. of Germany

[73] Assignee: Vereinigte Baubeschelagfrabriken Gretsch & Co. GmbH, Leonberg, Fed. Rep. of Germany

[21] Appl. No.: 969,086

[22] Filed: Dec. 13, 1978

[30] Foreign Application Priority Data

Dec. 22, 1977 [DE] Fed. Rep. of Germany ..... 2757393

[51] Int. Cl.[3] ..... A63C 9/08

[52] U.S. Cl. ..... 280/629

[58] Field of Search ..... 280/626, 629, 630, 623

[56] References Cited

U.S. PATENT DOCUMENTS 4,087,114 5/1978 Csosz ..... 280/629 X

*Primary Examiner*—Stanley H. Tollberg

[57] ABSTRACT

A safety toe unit for a ski binding in which a spring is used to urge together two pairs of complementary abutment surfaces defined between a toe clamp and a base portion to either side of the longitudinal axis of the unit. Sideways release is achieved by angular displacement of the toe clamp about either of the pairs of complementary abutment surfaces against the force of the spring. The present toe unit allows the toe clamp to be vertically adjusted while preserving the alignment between the line of action of the spring force and the toe clamp thus avoiding undesirable tilting moments which could affect the sideways release characteristics. The spring, which may be either in compression or tension, is adjustably located in an extension of the toe clamp between two spring abutments associated respectively with the toe clamp and base portion. Both spring abutments are arranged to move vertically with the toe clamp on adjustment of a vertical adjustment screw. Several embodiments are described.

28 Claims, 15 Drawing Figures

SAFETY TOE UNITS FOR SKI BINDINGS

Figure 1:
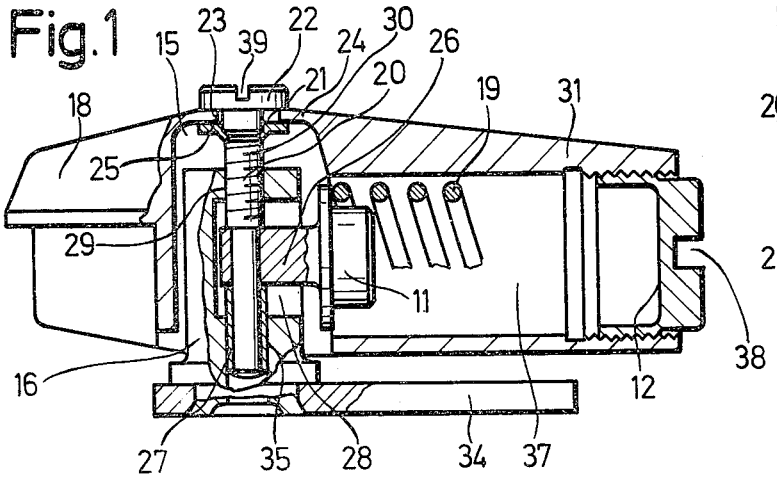

The present invention relates to a safety toe unit for a ski binding and has particular reference to a toe unit of the kind in which a toe clamp is supported on a base portion, which is adapted to be fitted to a ski, and in which the toe clamp can be angularly displaced sideways to release a ski boot of the occurence of excessive forces, such as are encountered during a fall.

Safety toe units of this kind are known, for example from German Offenlegungschrift 23 59 490 and German Offenlegungschrift 25 58 339 and basically comprise a base portion and a toe clamp, the toe clamp and base portion having two pairs of complementary abutment surfaces respectively disposed one to either side of the longitudinal axis of the toe unit and spring means for urging the two pairs of complementary surfaces into contact with each other. The pairs of complementary abutment surfaces are adapted so that the toe unit can be angularly displaced about either of the lines of contact between each of the pairs of complementary abutment surfaces against the force of said spring means to allow release of a ski boot either to the left or to the right of a ski on which the toe unit is mounted.

Both the pieces of prior art mentioned above include a screw-threaded arrangement between the toe clamp and the base portion which allows the height of the toe clamp above the base portion to be varied so that, in use, it can be adapted to suit various ski boots having soles of different thicknesses. The arrangement has however always been such that adjustment of the height of the toe clamp has meant that the toe clamp has moved relative to the spring means and the resulting displacement has had the serious disadvantage that the line of action of the spring and the loads applied to the toe unit via the ski boot have become misaligned to a greater or lesser extent and this has led to undesirable twisting moments and irregular loadings between cooperating relatively movable parts of the toe unit. These irregular and inconsistent effects can lead to an undesired mal - functioning of the toe unit. The spring means utilized in the prior art as mentioned above and the relative displacement between the toe clamp and spring housing has required a relatively complex adjusting mechanism and one result of this is that the complementary abutment surfaces are directly exposed to the outer environment and are disadvantageously affected by external influences such as water, ice and dirt etc.

The same disadvantages are manifest in another known safety toe unit disclosed in German Offenlegungschrift 19 64 306 in which the housing for the spring means is pivotable together with the sole clamp about a central bolt. In this case also the vertical adjustment of the toe clamp results in the alignment of the toe clamp with respect to the line of action of the spring being more or less disadvantageously influenced. In the same way vertical adjustability of the toe clamp requires a relatively large degree of trouble and expense as the toe clamp, which is separate from the spring housing, must be simultaneously adjusted via a common screw.

Safety release ski bindings are also known from German Auslegeschrift 22 59 916 and Swiss Pat. No. 491 652, especially a variant described in relation to FIG. 4, in which a toe clamp mechanism which is pivotable about side disposed axes, is arranged via a spring on a housing fixed relative to a ski. The vertical adjustment of the toe clamp is so constructed that it can be upwardly or downwardly adjusted to a greater or lesser extent via a screw-threaded bolt arranged in the housing. This relatively complex adjusting mechanism has however the disadvantage that vertical adjustment of the toe clamp also changes the inclination of the line of action of the spring to the horizontal so that a change in the spring tension is produced.

The prime object of the invention thus resides in providing a safety toe unit of the kind previously described which enables the manner in which the complementary abutment surfaces are loaded to be kept the same for all positions of vertical adjustment of the toe clamp without the need for expensive and complex constructional measures. Furthermore the present invention seeks to provide a safety toe unit which is largely insensitive to exterior influences.

Other objects and advantages of safety toe units in accordance with the present teaching are given in the subsequent description.

According to the present invention there is provided a safety toe unt for a ski binding comprising a base portion and a toe clamp, the toe clamp having two abutment surfaces and the base portion having two complementary abutment surfaces, the two pairs of complementary abutment surfaces being respectively disposed one to either side of the longitudinal axis of the toe unit and each pair defining a respective substantially vertically disposed pivot axis, there being provided spring means, operative between first and second spring abutments associated with the toe clamp and the base portion respectively, for urging the two pairs of complementary abutment surfaces into contact with each other, the unit being adapted to allow sideways angular displacement of the toe clamp relative to the base portion about either of said pivot axes against the force of said spring means, there being further provided means for adjusting the vertical position of the toe clamp relative to the base portion and means locating the spring abutments relative to the toe clamp for vertical movement together therewith whereby to maintain a constant relative alignment between the line of action of the force generated by said spring means at the abutment surfaces and the toe clamp.

The spring means is conveniently arranged as a coil spring with each of its two ends bearing on respective abutments with these abutments being arranged to be synchronously movable together with the sole clamp.

The coil spring can conveniently be either a tension spring or a compression spring but in either case one end of the spring will always act on a spring abutment fixed relative to the toe clamp.

In accordance with an especially advantageous embodiment the second spring abutment, which bears on the base portion, is made vertically adjustable relative to the abutment surfaces on the base portion by attaching it to the same adjustment screw as is used for adjusting the vertical height of the toe clamp, the screw being vertically arranged in the base portion. By this means the spring abutment which bears on the base portion is automatically vertically adjusted together with the toe clamp. These measures can be realized with a minimum of constructional problems.

It is especially advantageous if the spring abutment which bears on the base portion is made pivotable about the axis of the adjusting screw because this allows the spring to be housed within the smallest possible space within its housing and always ensures a trouble free, essentially straight line, force transmission from the spring, i.e. the spring can be made to act via an approximately constant length of lever arm. Preferably the adjusting screw is screw-threaded into the base portion. In this way the adjusting screw can be allowed to turn relative to the toe clamp and the second spring abutment, to produce vertical movement of the toe clamp and spring abutment relative to the base portion, but relative vertical movement between itself and the toe clamp and the second spring abutment can be prevented. The arrangement is preferably such that a certain amount of play is provided in a horizontal plane at the point at which the adjusting screw passes through the toe clamp. The constructional arrangement is usefully such that an aperture having the desired amount of play is provided in a top surface of the toe clamp and that the adjusting bolt passes through this aperture so that its head, or a washer arranged underneath the head, in combination with a further washer attached to the adjusting screw beneath the opening, have a sufficient horizontal extent that the toe clamp is vertically located without problem, in any position which it may in operation adopt, and so that the interior of the toe clamp is protected against the ingress of matter via the opening.

The spring abutment which bears on the base portion preferably has a projection which is rotatably but not axially displaceably arranged on the adjusting screw. Furthermore it is convenient if a sleeve is arranged on the adjusting screw beneath the projection and is riveted or otherwise fixed thereto.

An especially preferred embodiment is characterized in that the base portion has a post vertically upstanding from a base plate adapted to be secured to a ski and for the post to have a recess through which the adjusting screw passes and which can receive the associated spring abutment or a projection from this spring abutment. In an arrangement of this kind it is only necessary to provide a thread in the post above the recess and to provide the adjusting screw with a corresponding thread only in this region. The lower end of the adjusting screw, which may be provided with the aforementioned sleeve, is conveniently arranged to be rotatable and axially displaceable in a bore formed in the lower part of the post.

It is especially advantageous for the complementary abutment surfaces associated with the base portion to be provided on the post. This arrangement can be particularly economically manufactured and is simple to assemble.

The spring means is advantageously located in a housing which is rigidly connected with the toe clamp. In this particularly simple arrangement the housing and the toe clamp form a single unitary part which cannot only pivot about either of the pairs of complementary abutting surfaces, but can also be vertically adjusted by means of the adjustment screw which results in relative vertical displacement of the complementary abutment surfaces on the toe clamp and base portion respectively.

It is especially advantageous for the toe clamp and/or the housing to totally enclose the complementary abutment surfaces. In this manner the complementary abutment surfaces can be effectively protected against contamination from outside and against the entry of snow, without a large constructional effort.

In accordance with a further embodiment of the invention the post can be formed from two vertically upstanding sheet metal side members joined at two vertically spaced apart positions by horizontal sheet metal members. An arrangement of this kind can be readily manufactured.

A first possibility for the arrangement of the toe clamp and the spring means is for the toe clamp and the spring means to be arranged on opposite sides of the complementary abutment surfaces. In an arrangement of this kind the spring means can comprise a compression spring arranged between a spring abutment which bears on the base portion and an adjustable abutment provided in the housing. In another variation the spring means is constructed as a tension spring which extends between an abutment fixed to the toe clamp in the vicinity of the complementary abutment surfaces and an adjustable abutment accessible from outside the toe unit which is connected to the base portion via a compression rod.

In order for the adjustment of the spring tension to be capable of being carried out in simple manner a modification of this embodiment is provided with a compression rod which is sub-divided into two relatively rotatable parts one of which extends through the adjustable abutment and is connected thereto by screw threads. A further embodiment which is exceptionally compact is characterized in that the spring means is arranged on the same side of the complementary abutment surfaces as the toe clamp. In a first variant of this embodiment the spring means is a tension spring arranged between a spring abutment at its one end which is supported on the base portion of the toe unit and a spring abutment at its other end which is attached to the toe clamp, and which is preferably adjustably connected thereto by means of screw threads. In another variation of this embodiment the spring means is a compression spring which is arranged between an abutment associated with the toe clamp of the toe unit and located in the vicinity of the complementary abutting surfaces and an adjustable abutment which is accessible from outside the toe unit and which is connected to the base portion via a rod.

Adjustment is possible with this variant by rotating the adjustable abutment which cooperates with screw threads provided on the rod to adjust the precompression in the compression spring.

The invention is intended in addition to ensure that the resetting torque which occurs on angular displacement of the toe clamp changes as little as possible in relation to the initial value with the toe clamp in its normal straight ahead position. The invention allows this aim to be realized if the angular separation $\beta$ between the perpendicular from either of the pairs of complementary abutment surfaces to the longitudinal axis of the toe unit and the line joining that vertical pivot axis to the pivotal axis of the second spring abutment relative to the base portion is kept in the range minus $\alpha/2$ to plus $\alpha$ where $\alpha$ is the maximum angular displacement of the toe clamp. This arrangement of the pivot axis in conjunction with the one piece form of the toe clamp and spring housing is of particular significance. The effect of the angular displacement of the toe clamp on the resetting torque is made even less when, in accordance with an especially preferred embodiment, the size of the angular separation $\beta$ lies between 0 and plus $\alpha/2$.

The maximum angular displacement of the toe clamp $\alpha$ is defined by that angle at which a ski boot previously held by the binding can slide out of the binding after which the toe clamp can snap back into its original position. This maximum angular displacement of the toe clamp can be defined independently of the particular ski boot to be equivalent to the absolute value in degrees of one quarter of the separation between the two pairs of complementary abutment surfaces as measured in mm plus an amount in the range 9° to 14° and preferable 11°.

Figure 1A:
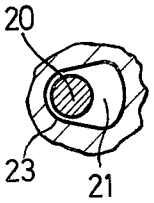
Figure 2:
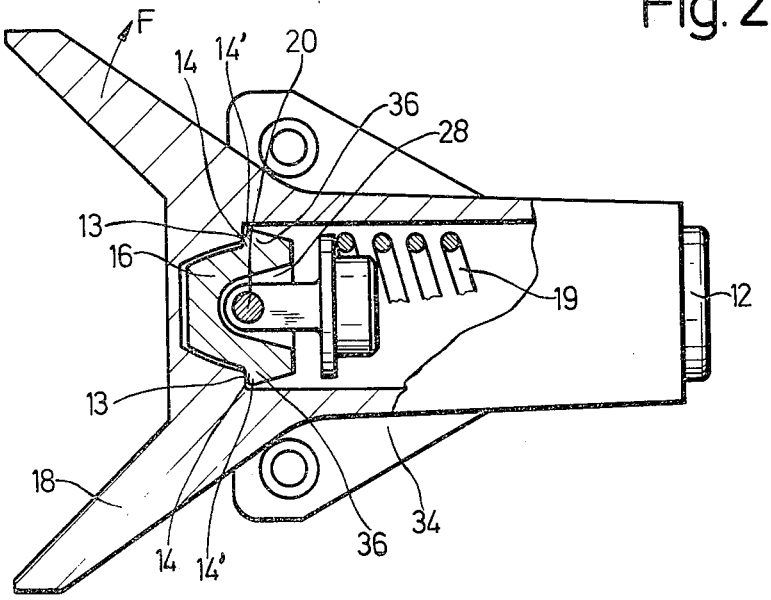
Figure 4:
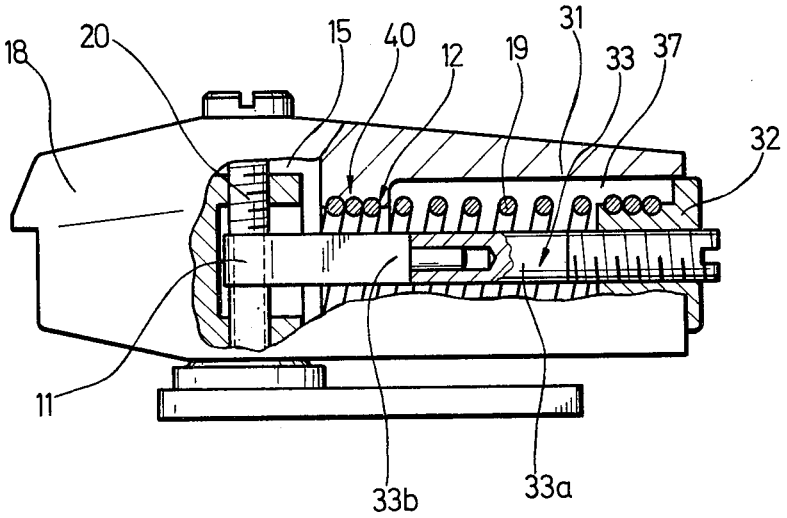
Figure 3:
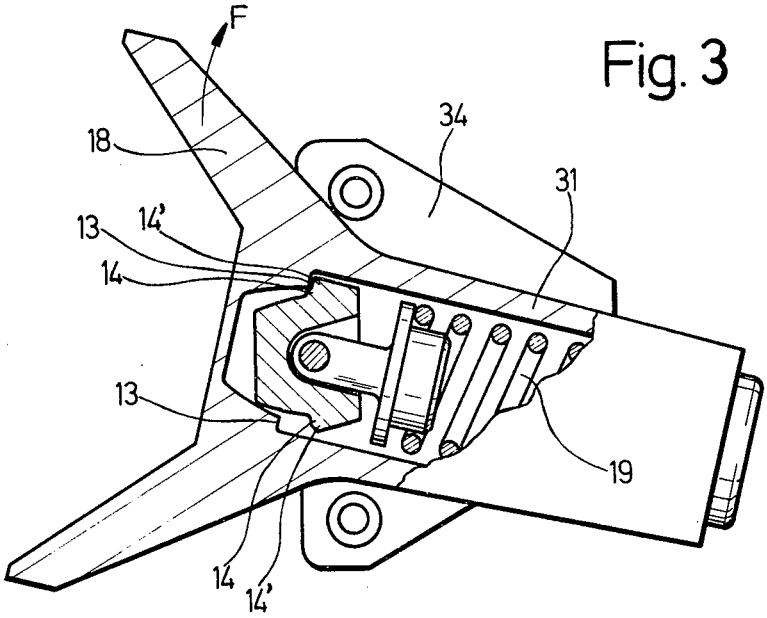
Figure 5:
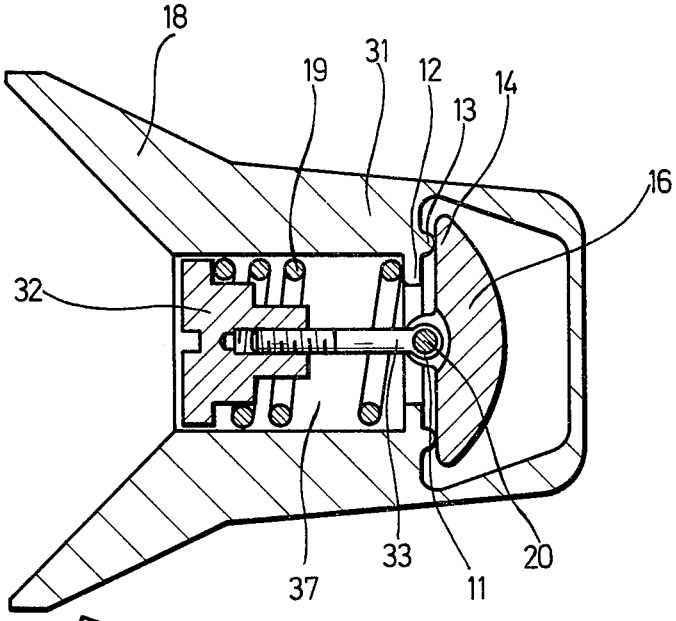
Figure 6:
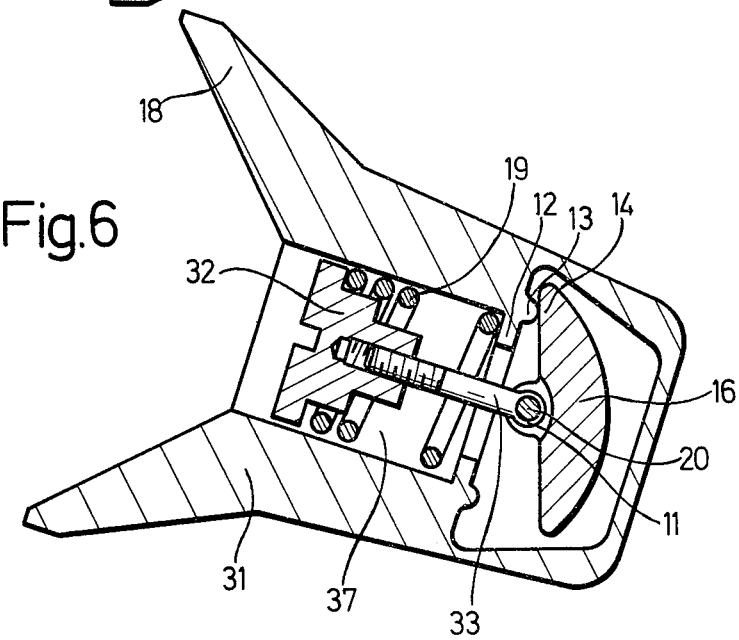
Figure 7:
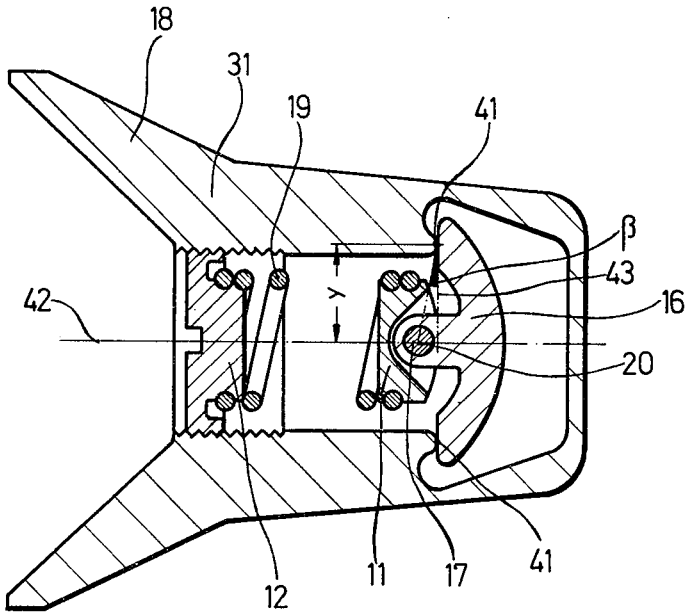
Figure 8:
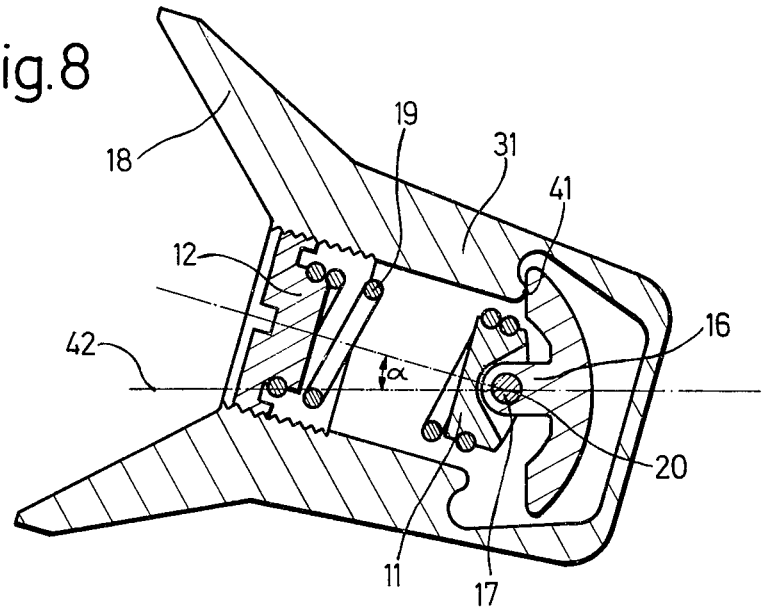
Figure 9:
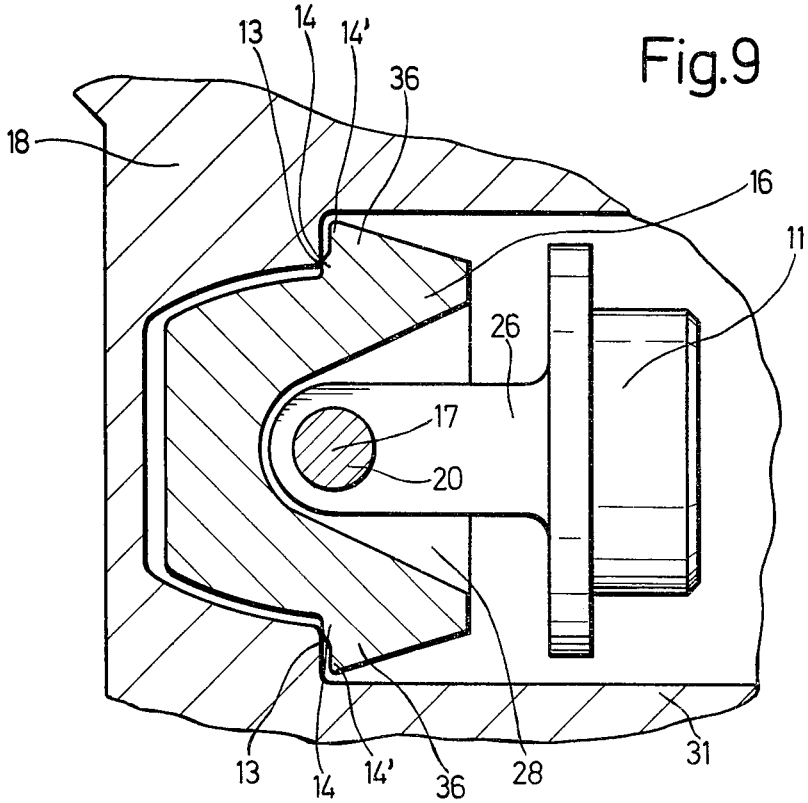
Figure 10:
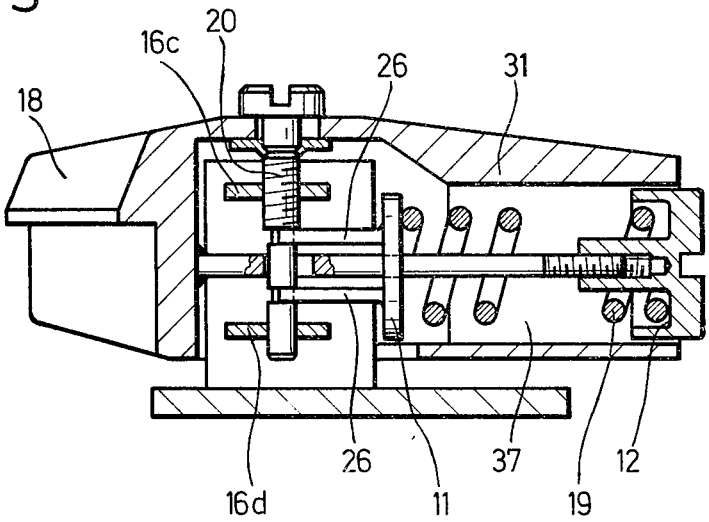
Figure 11:
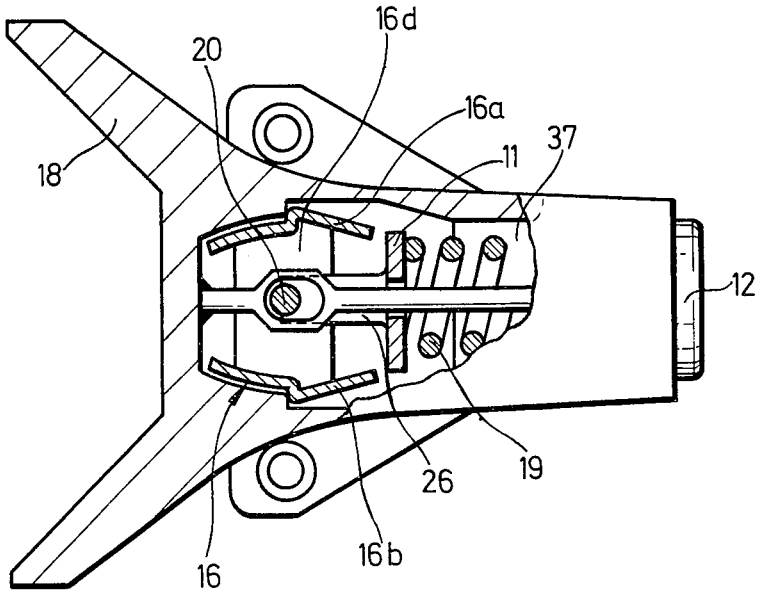
Figure 12:
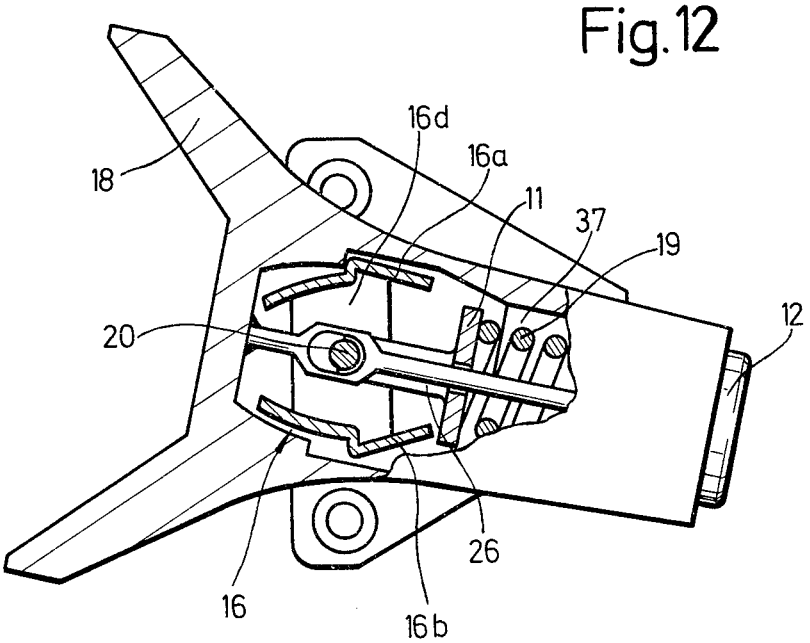
Figure 13:
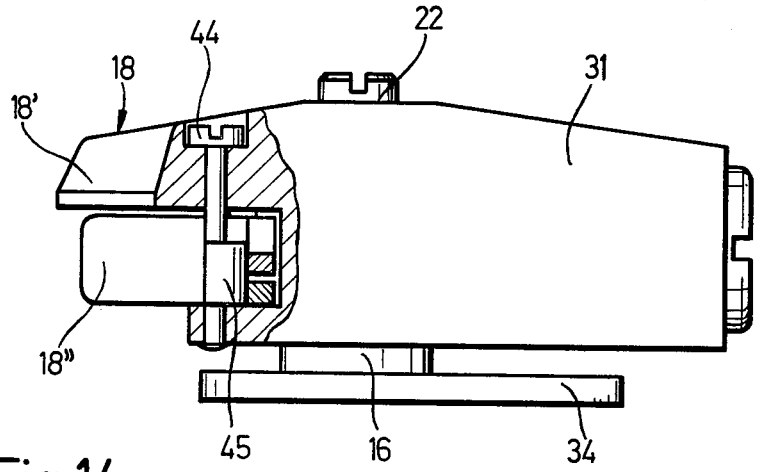
Figure 14:
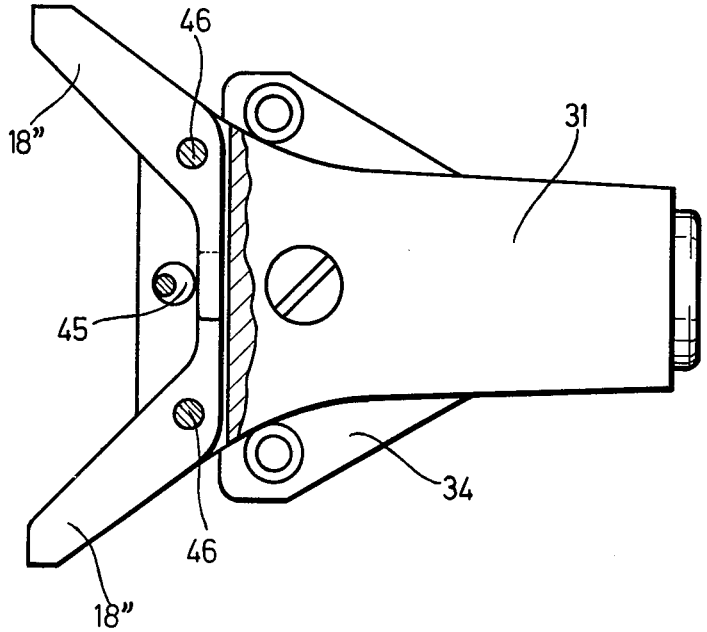

The invention will now be described in more detail by way of example only and with reference to the accompanying drawings in which are shown:

FIG. 1 a partly sectioned side view of a first embodiment of a safety toe binding, FIG. 1*a* a detail of the location for the adjusting screw of the toe safety binding of FIG. 1 as seen in plan view, FIG. 2 a partially sectioned plan view of the subject of FIG. 1, FIG. 3 a similar view to that of FIG. 2, but showing the toe safety binding in its position following a sideways release, FIG. 4 a partly sectioned side view of a further embodiment, FIG. 5 a partly sectioned plan view of a further embodiment of a toe safety binding having a release spring incorporated in the toe clamp, FIG. 6 a view similar to that of FIG. 5 but showing the toe safety binding in its displaced position following a sideways release, FIG. 7 a horizontal section of a further embodiment in which the release spring is arranged within the toe clamp, FIG. 8 a view similar to that of FIG. 7 but showing the toe clamp in its displaced condition following a sideways release, FIG. 9 an enlarged scale of a detail of the embodiment of FIG. 2 illustrating a particularly preferred manner of cooperation between complementary supporting surfaces, FIG. 10 a partly sectioned side view of a further embodiment of a toe safety binding, FIG. 11 a partly sectioned plan view of the subject of FIG. 10, FIG. 12 the binding of FIG. 11 in its displaced position the following a sideways release, FIG. 13 a partly sectioned side view of a further embodiment in which the width of the toe clamp is adjustable, and FIG. 14 a plan view of the subject of FIG. 13.

In general the figures illustrate various embodiments of a toe binding or toe unit which all share the common general features of a toe clamp 18 and a base portion 34 with two pairs of complementary abutment surfaces (13, 14) defined between them. The two pairs of complementary abutment surfaces are respectively disposed on either side of the central longitudinal axis of the toe unit and are urged into contact by means of a spring 19 located within the toe clamp 18. The arrangement is such that the toe clamp can be angularly displaced sideways about either of the vertical pivot axes defined by each pair of complementary abutment surfaces, against the force of the spring, to effect sideways release of a ski boot clamped by the toe unit.

As the various embodiments all have certain parts with common functions these parts are all designated by the same reference numerals.

Referring first of all to FIGS. 1 and 2 there can be seen a toe safety binding which is adapted to be fastened to a ski by a base plate forming part of a base portion 34. A post 16 is arranged in a vertically upstanding position on the base plate and is connected therewith by spreading its lowermost end to form a rivetted connection.

The post 16 has the longitudinal- and cross- sections shown in FIGS. 1 and 2. From the vertically sectioned part of FIG. 1 it can be seen that the post 16 has a recess 28 the entrance to which is located at the forward side, i.e. the ski tip side, of the post 16. A vertically arranged bore passes through the post 16 and the top part of this bore above the recess 28 is provided with screw threads 29 whilst the lower part of this bore has smooth sides 35.

It can be seen from the cross-sectional view of FIG. 2 that the post 16 has two projections 36 at its sides on which are formed the rearward facing surfaces 14, 14' which, together with corresponding abutment surfaces 13, 13' formed on the toe clamp 18, define two pairs of complementary abutment surfaces. The abutment surfaces 14, 14' and the complementary abutment surfaces 13, 13' can be seen in detail from the enlarged illustration of FIG. 9. The abutment surfaces 13, 13' and the complementary surfaces 14, 14' respectively extend over a predetermined vertical distance. The height of the two surfaces must be so arranged that a sufficient mating area between the surfaces is present over the whole range of the vertical adjustability of the toe clamp 18.

The toe clamp 18 is manufactured in one piece with a spring housing 31 which extends forwardly from the abutment surfaces 13. A compression spring 19 is located within the inner space 37 of the spring housing 31 and the forward end of this spring, i.e. the end nearest the tip of the ski, sits on a first spring abutment 12 in the form of a screw threaded into the end of the spring housing. The precompression in the spring 19 can be adjusted by rotating the abutment 12, for example by applying a screw driver or a coin to the slot 38 which is provided in the spring abutment 12. The rearward end of the compression spring 19, i.e. the end of the spring which faces the rearward end of the ski abuts against a second spring abutment 11 which is mounted via a projection 26 on an adjusting screw 20. The second spring abutment 11 can rotate about the adjusting screw 20 but is not axially displaceable relative thereto. The adjusting screw 20 has an upper threaded portion 30 and a smooth lower portion which passes through a bore in the projection 26 into a sleeve 27 which is located beneath the projection 26. The sleeve 27 is so rivetted to the bottom end of the adjusting screw 20 that it turns together therewith but cannot be axially displaced relative thereto. The projection 26 is largely housed within the recess 28 and sufficient space is left both above and below the projection 26 within the recess 28 to allow the vertical position of the toe clamp to be adjusted. There is also provided sufficient space between the projection 26 and the sides of the recess 28 to allow the second spring abutment 11 to rotate about the adjusting screw 20 during pivotal movement of the sole clamp 18.

The post 16 extends vertically upwardly into a hollow space 15 provided between the sole clamp 18 and the spring housing 31. The hollow space 15 is enclosed both at its sides and from above. As can be seen from FIG. 1*a* the upper closure for the hollow space 24 has an opening 23 through which the adjusting screw 20 passes. The opening 23 has the shape shown in FIG. 1*a*, i.e. it becomes progressively broader in the forward direction so that a certain amount of clearance 21 exists between the adjusting screw 20 and the housing 31. The screw 20 has a head 22 which is located above the opening 23 provided in the cover 24 and which is sufficiently wide that it secures the toe clamp vertically irrespective of the angular position thereof. A securing disk 25 is fastened directly below the opening 23. The arrangement is such that the adjusting screw 20 can be rotated within the opening 23 and the cooperation between the threaded part of the adjusting screw and the post 16 allows the toe clamp 18 and the spring housing 31 to be raised or lowered relative to the post 16.

As can be seen from FIG. 9 the toe clamp 18 rests, in its normal operative position, with both its abutment surfaces 13 in contact with the corresponding complementary surfaces 14 of the post 16. If now a sideways release takes place in the direction of the arrow F, such as could for example occur during a fall by a skier, then the toe clamp 18 together with the housing 31 moves, once a specified release force has been exceeded, into the position shown in FIG. 3 in which a ski boot is able to disengage sideways from the binding. In accordance with the invention, the left hand abutment surface 13 rolls on the complementary surface 14 during a sideways release to the left. As a result the right hand abutment surface 13 and the associated complementary surface 14 part company as can be seen from FIG. 3.

Above a predetermined angle of pivotal movement of the toe clamp 18 the outermost complementary surface 14' contacts the abutment surface 13 so that the pivotal axis defined by the rolling movement is displaced further to the side. During this pivotal displacement of the toe clamp the compression spring 19 is compressed.

After a ski boot, previously held by the binding, has left the binding the toe clamp 18 snaps back into its initial position because the spring 19 generates a corresponding resetting moment. Finally the toe clamp rests once more in its normal position as shown in FIG. 2. If it is desired to adjust the height of the sole clamp 18 then it is only necessary to rotate the adjustment screw 29, by means of the actuation slot 39 in one or other of the two possible opposite directions of rotation. A rotation of the adjustment screw of this kind results in the adjusting screw moving up or down relative to the post 16. During this movement not only the toe clamp 18 and the housing 31 (which are constructed as a single piece) but also the projection 26 which carries the second spring abutment 11 are caused to move together with the adjustment screw 20. During vertical adjustment the abutment surfaces 13 and the complementary surfaces 14 are also relatively displaced in a vertical direction.

In the embodiment of FIG. 4 the arrangement is modified to utilize a tension spring 19 in the housing 31 in place of the compression spring. The tension spring 19 is fastened at location 40 to the housing 31 adjacent to the pivotal support for the housing on the adjusting screw. The tension spring 19 is fastened by its forward end to a spring abutment, nut 32, which is secured against rotational displacement. A compression rod 33 is connected by a screw threaded portion **33*a* to the spring abutment 32. The other part 33*b* of the compression rod 33, relative to which the part 33*a* can be rotated, is attached to the adjusting screw 20 in the same manner as the projection 26 in the embodiments of FIGS. 1 to 3. The end 11 of the compression rod 33 thus connects the second spring abutment 32 to the base portion 34 via the adjusting screw 20**.

In other respects the construction of the embodiment of FIG. 4 is the same as that of the embodiment of FIGS. 1 to 3. The operation of the embodiment is also equivalent.

The part **33*a* of the compression rod 33 can be rotated from outside of the toe binding to increase or decrease the pre-tension in the tension spring 19**.

Referring now to FIGS. 5 and 6 there is shown an alternative arrangement in which a compression spring 19 is arranged within the toe clamp 18. The toe clamp 18, as in the previous embodiment includes a forwardly disposed housing 31 which forms a unit with the toe clamp 18. In this embodiment the post 16 has an elongate cross-section, as can be seen from FIGS. 5 and 6 and is rounded on its front face but generally flat on its rear face. The compression coil spring 19 bears at its forward end on a step 12 which forms the first spring abutment and has as adjustable abutment 32 at its rear end and is so arranged that a rod 33 screw-threaded into the adjustable second abutment 32 passes along the axis of the coil spring and is pivotally anchored at it forward end 11 onto the adjustment screw 20 which is secured to the post 16 in similar manner to the corresponding adjustment screw of FIGS. 1 to 3. Rotation of the adjustable abutment nut 32 allows the precompression in the spring 19 to be adjusted.

The manner of operation of the embodiment of FIGS. 5 and 6 is analogous to that of the previous exemplary embodiments. The particular advantage of the embodiment of FIGS. 5 and 6 resides in the fact that all the component parts of the binding are located behind the pivotal axis of the sole clamp and extend towards the position occupied by the ski boot and thus that they require hardly any space in the forward direction towards the ski tip.

Turning now to FIGS. 7 and 8 there is shown an embodiment similar to that of FIGS. 5 and 6 but in which a tension spring 19 is used in substitution for a compression spring. In this embodiment the spring is fastened by its forward end to a spring abutment 11 and the spring abutment is pivotally connected to the adjusting screw 20 in similar manner to the projection 26 of the exemplary embodiment of FIGS. 1 to 3. The rear end of the tension spring 19 is connected to an abutment 12 which is screw-threaded into the toe clamp 18 so that the tension of the tension spring 19 is adjustable. The manner of operation of this embodiment corresponds to that of the previously described exemplary embodiments.

Referring now to FIGS. 10 and 11 there is shown a further modification in which the column 16 is formed from two sheet metal side members **16*a* and 16*b* and two transverse sheet metal members 16*c* and 16*d* which respectively connect together the two spaced apart side members at two vertically spaced apart upper and lower positions. The rearward end of the compression spring 19 sits on a spring abutment 11 which has a vertically arranged flange and two rearwardly extending vertically separated projections which are provided with vertically aligned bores through which the adjusting screw 20 passes. A distance piece arranged as a sleeve coaxial with the adjusting screw is located between the two rearward projections 26. The arrangement of the spring abutment 11 on the adjusting screw 20 is analogous to the embodiment of FIGS. 1 to 3**.

The embodiment of FIGS. 10 and 11 differs from the embodiment of FIGS. 1 to 3 in that a rod extends from the toe clamp 18 and through the spring chamber 37 and is connected via a screw thread into the spring abutment 12 at the forward end of the spring 19. The spring abutment 12 is freely rotatable relative to the housing 31 and the screw threaded attachment to the rod allows the precompression in the spring 19 to be adjusted. It will be noted that the rod passes through a central aperture in the spring abutment 11 and has itself an elongated aperture through which the adjusting screw 20 and afore-mentioned distance piece pass. The elongated aperture allows angular displacement of the toe clamp 18 without the occurence of binding between the rod and the vertical adjusting screw 20 (FIG. 12). The displacements undergone by various parts of the toe binding during release will now be described with reference to the nomenclature shown in FIGS. 7 and 8. FIG. 8 shows the maximum angle of displacement $\alpha$ of the toe clamp, and thus of the housing 31 which is connected to the toe clamp, about the axis of the adjusting screw 20. FIG. 7 shows the angular clearance $\beta$ between the pivot axis 17 of the spring abutment 11 and one of the vertical pivot axes 41 between the complementary abutment surfaces on the toe clamp 18 and post 16. The two possible vertical pivot axes 41 are arranged symmetrically about the central longitudinal axis 42 of the toe binding so that the angular clearance $\beta$ is the same for both lines of contact. The angle $\beta$ is defined to lie between the perpendicular from the vertical pivot axis 41 to the central longitudinal axis 42 and the line joining the vertical pivot axis 41 to the pivot axis 17.

In order to achieve as far as possible a lever arm of constant length on which the spring force bears, during angular displacement of the toe clamp up to the maximum possible angle of $\alpha$, the angular clearance $\beta$ should lie between minus $\alpha/2$ and plus $\alpha$ and should preferably lie between 0 and $\alpha/2$. The angle $\beta$ as illustrated in FIG. 7 is positive. A negative angle of $\beta$ would mean that the pivot axis 17 lay forwardly of the vertical pivot axis 41.

In other words the pivot axis 17 of the spring abutment 11 should preferably be arranged in the vicinity of the imaginary connecting plane between the two vertical pivot axes 41 however preferably slightly behind this plane.

The maximum angular displacement $\alpha$ is achieved when the binding has reached a position in which a ski boot previously engaged with the binding would be released. This angle is approximately given by the following formula:

$$\alpha^\circ = |Y/2|^\circ + 11^\circ$$

where y is the perpendicular distance from the vertical pivot axes 41 to the central longitudinal axis 42 as shown in FIG. 7 and measured in mm.

Referring now to FIGS. 13 and 14 there is shown a toe binding which in general corresponds to the construction of the toe binding of FIGS. 1 to 3. However the toe clamp 18 is sub-divided into two side restraints 18'' and a central clamp 18'. The two side restraints 18'' can be adjusted by means of an excentric sleeve 45 mounted on an adjusting screw 44 which passes through the central clamp 18' so as to allow the positions of the two side restraints 18'' to be adjusted to suit various ski boot toe shapes and widths. To produce synchronous adjustment, the side restraints are mounted about respective vertical pivot axes 46 and each has an inwardly turned leg with a vertical bore therein, the arrangement being such that both vertical bores overlap one another and the excentric 45 passes through both bores. The rotation of the excentric 45 through an angle of 180° results in the two side restraints pivoting in opposite rotational directions about their respective vertical pivot axes 46 by means of which they are connected to the sole clamp 18. The embodiment of FIGS. 13 and 14 is intended to show that the present teaching can also be used in connection with sole clamps having adjustable side restraint members.

Other modifications will also be apparent to those skilled in the art without departing from the scope of the present teaching.

I claim:

1. A safety toe unit for a ski binding, the toe unit comprising a base portion, a toe clamp mounted from said base portion and comprising at least a body portion and a horizontally disposed ledge fixed relative to the body portion for locating the upper surface of the sole of a ski boot, said toe clamp having first and second abutment surfaces and the base portion having first and second complementary abutment surfaces, respectively cooperable with respective ones of said first and second abutment surfaces to define first and second pivot axes substantially vertically disposed one to either side of the longitudinal axis of the toe unit, spring means operative between first and second spring abutments associated with the toe clamp and base portion respectively for biasing the said abutment surfaces on the toe clamp and the base portion into contact with each other, the unit being adapted to allow sideways displacement of the toe clamp relative to the base portion about either of said first and second pivot axes against the force of said spring means, a vertically disposed adjustment screw for adjusting the vertical position of the toe clamp relative to the base portion, and means locating the first and second spring abutments and the toe clamp including said ledge for joint movement relative to the base portion on adjustment of said vertically disposed adjustment screw.

2. A safety toe unit according to claim 1 and characterized in that the first spring abutment is rigidly connected to said toe clamp for vertical movement together therewith during adjustment of the vertical position of said toe clamp.

3. A safety toe unit according to claim 1 and in which the second spring abutment is connected to the base portion via said screw for adjusting the vertical position of the toe clamp and is vertically movable together with said toe clamp on adjustment of said screw.

4. A safety toe unit according to claim 3, and in which said vertically disposed adjustment screw has screw threads cooperating with mating screw threads in one of said toe clamp and said base portion.

5. A safety toe unit according to claim 4 and in which the second spring abutment is pivotally connected about the axis of said adjustment screw.

6. A safety toe unit according to claim 5 and in which the screw threads of said adjustment screw cooperate with screw threads in said base portion, there being means for ensuring axial movement of the second spring abutment together with said adjustment screw and means defining a clearance between the adjustment screw and the toe clamp to accommodate said sideways displacement of the toe clamp.

7. A safety toe unit according to claim 6 and in which said means defining said clearance comprises an aperture in the top surface of the toe clamp of greater extent than the cross section of said adjustment screw and in which means are provided between said toe clamp and said adjustment screw for ensuring vertical movement of the toe clamp with the adjustment screw, said means comprising a head on said adjustment screw located on one side of the aperture and a disc axially located on the adjustment screw on the other side of said aperture, both the head and the disc having a horizontal extent relative to the aperture such that the vertical location of the toe clamp is maintained irrespective of its angular displacement.

8. A safety toe unit according to claim 6 and in which the second spring abutment includes a projection which engages said axial adjustment screw.

9. A safety toe unit according to claim 8 and in which a sleeve is fixedly connected to the adjustment screw beneath said projection, said sleeve defining a shoulder for axially locating the projection relative to said adjustment screw.

10. A safety toe unit according to claim 6 and in which said base portion includes a vertically upstanding post, the post having a recess adapted to receive at least a part of the second spring abutment and wherein the adjustment screw is located in said post and passes through said recess.

11. A safety toe unit according to claim 10 and in which the cooperating screw threads on said adjustment screw and base portion comprise screw threads provided in the post solely above the recess, the adjustment screw having adjustment screw threads only over a corresponding part of its length.

12. A safety toe unit according to claim 10 and in which said adjusting screw is provided with a sleeve beneath the second spring abutment, the sleeve being rotatably and axially displaceably journalled in the lower part of said post.

13. A safety toe unit according to claim 10 and in which the complementary abutment surfaces on said base portion are provided on the post.

14. A safety toe unit according to claim 1 and in which the spring means is located within a housing carried on said toe clamp.

15. A safety toe unit according to claim 14 and in which the said abutment surfaces and complementary abutment surfaces are substantially surrounded by at least one of the toe clamp and the housing.

16. A safety toe unit according to claim 10 and in which said post comprises two sheet metal side members joined together by two vertically spaced apart sheet metal cross members.

17. A safety toe unit according to claim 1 and in which the toe clamp and the spring means are located on opposite sides of an imaginary plane joining the abutment surfaces and complementary abutment surfaces.

18. A safety toe unit according to claim 17 and in which the spring means comprises a compression coil spring disposed between said first and second spring abutments, the first spring abutment being adjustably screw threaded into said housing.

19. A safety toe unit according to claim 17 and in which the spring means comprises a tension spring and in which the first spring abutment is fixedly located on the toe clamp adjacent said complementary abutment surfaces and the second spring abutment is externally accessible and is connected to said base portion via a rod which is loaded in compression, the end of the rod remote from this abutment being pivotally connected to said base portion.

20. A safety toe unit according to claim 18 and in which said rod is subdivided into two relatively rotatable parts, one of said parts being provided with screw threads cooperating with screw threads provided in said second spring abutment to permit adjustment of the spring tension.

21. A safety toe unit according to claim 1 and in which the spring means and the toe clamp are arranged on the same side of an imaginary plane joining said abutment surfaces and complementary abutment surfaces.

22. A safety toe unit according to claim 21 and in which the spring means comprises a tension spring and in which the first spring abutment is adjustably connected to the toe clamp by means of cooperating screw threads.

23. A safety toe unit according to claim 21 and in which said spring means comprises a compression spring, the first spring abutment being fixedly connected to the toe clamp in the region of said abutment surfaces and complementary abutment surfaces and the second spring abutment being externally accessible and connected to said base portion via a tie rod, the end of the tie rod remote from the second spring abutment being pivotally connected to said base portion.

24. A safety toe unit according to claim 23 and in which the second spring abutment is adjustably connected to said tie rod by means of cooperating screw threads.

25. A safety toe unit according to claim 1 in which the second spring abutment is pivotally connected to the base portion about a further vertically disposed pivot axis and wherein the angle (13) measured between the perpendicular line joining either of the first said vertical pivot axes to the central longitudinal axis of the toe unit and the line joining that vertical pivot axis to the said further vertically disposed pivot axis lies in the range between ($-\alpha/2$ and $+\alpha$) where $\alpha$ is the maximum sideways angular displacement of the toe clamp.

26. A safety toe unit according to claim 25 and in which the angle $\beta$ lies in the range (0 to $+\alpha/2$).

27. A safety toe unit according to claim 24 and in which the maximum sideways angular displacement of the toe clamp is made equal to the absolute value in degrees of one quarter of the distance between the first said vertical pivot axes as measured in millimeters plus an additional amount in the range 9° to 14°.

28. A safety toe unit according to claim 27 and in which said additional amount is 11°.

* * * * *